US011594361B1

(12) United States Patent
Farahani et al.

(10) Patent No.: US 11,594,361 B1
(45) Date of Patent: Feb. 28, 2023

(54) TRANSFORMER HAVING PASSIVE COOLING TOPOLOGY

(71) Applicant: Smart Wires Inc., Union City, CA (US)

(72) Inventors: Ali Farahani, Yorba Linda, CA (US); Haroon Inam, San Jose, CA (US)

(73) Assignee: Smart Wires Inc., Durham, NC (US)

( * ) Notice: Subject to any disclaimer, the term of this patent is extended or adjusted under 35 U.S.C. 154(b) by 639 days.

(21) Appl. No.: 16/444,880

(22) Filed: Jun. 18, 2019

Related U.S. Application Data

(60) Provisional application No. 62/781,494, filed on Dec. 18, 2018.

(51) Int. Cl.
*H01F 27/22* (2006.01)
*H01F 27/32* (2006.01)

(52) U.S. Cl.
CPC ..... *H01F 27/22* (2013.01); *H01F 27/324* (2013.01); *H01F 27/327* (2013.01)

(58) Field of Classification Search
CPC .. H01F 27/00–40; H01F 27/22; H01F 27/324; H01F 27/327
See application file for complete search history.

(56) References Cited

U.S. PATENT DOCUMENTS 1,807,441 A * 5/1931 Schurig ..... H01C 7/18 338/234
3,524,126 A * 8/1970 Hans ..... H01F 30/16 323/359
4,829,207 A 5/1989 Hovorka
4,874,916 A * 10/1989 Burke ..... H05B 6/02 219/671
4,897,626 A 1/1990 Fitter
5,210,513 A 5/1993 Khan et al.
5,395,210 A * 3/1995 Yamazaki ..... F04D 23/008 415/55.1
5,396,210 A * 3/1995 Purohit ..... H01F 41/005 336/60
5,726,858 A 3/1998 Smith et al.
5,920,249 A * 7/1999 Huss ..... H01F 41/00 336/65

(Continued)

FOREIGN PATENT DOCUMENTS

EP 3528266 A1 * 8/2019 ..... H01F 27/324
EP 3576106 A1 * 12/2019 ..... G01K 11/3206

*Primary Examiner* — Tuyen T Nguyen
(74) *Attorney, Agent, or Firm* — Womble Bond Dickinson (US) LLP

(57) ABSTRACT

A passive cooling topology and a manufacturing method are described for a transformer to achieve improved power density at a light weight. No fans or cooling liquids are required. Vertical planar faces are used for the central core element, the primary and secondary windings, the outer core element, and a finned heat sink. The primary flow for thermal cooling is radial, through the vertical planar faces. The transformer may be configured to float at the potential of a high voltage transmission line, leading to improved thermal characteristics. Eddy currents are reduced using repeating air gaps in the central core, and a continuously transposed cable comprising multiple strands per turn in the secondary winding. Air pockets in the windings are eliminated using a potting resin and vacuum pressure impregnation (VPI).

14 Claims, 3 Drawing Sheets

(56) References Cited

U.S. PATENT DOCUMENTS

| | | | | |
|---|---|---|---|---|
| 5,926,944 | A | 7/1999 | Smith et al. | |
| 6,081,082 | A | 6/2000 | Kim et al. | |
| 6,174,309 | B1 | 1/2001 | Wrublewski et al. | |
| 6,185,811 | B1 | 2/2001 | Perry | |
| 6,259,347 | B1 | 7/2001 | Sines | |
| 6,489,551 | B2 | 12/2002 | Chu et al. | |
| 6,492,890 | B1 * | 12/2002 | Woznlczka | H01F 27/22 336/198 |
| 6,563,410 | B1 | 5/2003 | Marton | |
| 6,777,835 | B1 | 8/2004 | Sines | |
| 6,822,404 | B2 | 11/2004 | Matsumoto et al. | |
| 7,019,996 | B2 | 3/2006 | Zhu et al. | |
| 7,088,211 | B2 | 8/2006 | Moncada et al. | |
| 7,468,648 | B2 | 12/2008 | Springett | |
| 7,911,308 | B2 | 3/2011 | Rippel | |
| 8,072,305 | B2 | 12/2011 | Nakahor | |
| 8,358,506 | B2 | 1/2013 | Cooper et al. | |
| 8,402,636 | B2 | 3/2013 | Park et al. | |
| 2002/0062855 | A1 | 5/2002 | Chu et al. | |
| 2003/0168988 | A1 | 9/2003 | Matsumoto et al. | |
| 2005/0012585 | A1 | 1/2005 | Moncada et al. | |
| 2005/0083714 | A1 | 4/2005 | Zhu et al. | |
| 2006/0181837 | A1 | 8/2006 | Sun et al. | |
| 2007/0296533 | A1 | 12/2007 | Springett | |
| 2008/0239759 | A1 | 10/2008 | Nakahor | |
| 2009/0302986 | A1 | 12/2009 | Bedea | |
| 2010/0127810 | A1 | 5/2010 | Rippel | |
| 2011/0304255 | A1 | 12/2011 | Miller et al. | |
| 2012/0050999 | A1 | 3/2012 | Cooper et al. | |
| 2012/0301172 | A1 * | 11/2012 | Odate | G03G 15/80 399/88 |
| 2016/0066414 | A1 | 3/2016 | Jow et al. | |
| 2020/0059136 | A1 * | 2/2020 | Yang | H02K 1/06 |

* cited by examiner

TRANSFORMER HAVING PASSIVE COOLING TOPOLOGY

CROSS REFERENCE TO RELATED APPLICATIONS

This application claims the benefit of U.S. Provisional Application No. 62/781,494 filed on Dec. 18, 2018, the disclosure of which is incorporated herein by reference.

TECHNICAL FIELD

Embodiments of the invention relate to a transformer having passive cooling technology, and more particularly to a small size and light weight transformer that is optimized for use in a power flow control system.

BACKGROUND

Power flow control devices that are constructed for optional attachment to power transmission lines are preferably light in weight and of minimum size. Accordingly, for power flow devices that incorporate a power transformer, it is desirable to use a passive cooling topology that eliminates cooling liquids and pumping equipment and fans.

In a transformer implementation, eddy current losses are preferably minimized since they decrease both electrical and thermal efficiency. High voltage operation of a transformer may include features (such as air pockets) that may arc unless mitigating strategies are employed. Such arcing can quickly lead to failure of the transformer. Insulating materials may be chosen that withstand high dielectric stress while also providing good thermal conductivity.

Accordingly, there is a need in the art for a transformer of small size and light weight optimized for use in a power flow control system.

BRIEF DESCRIPTION OF THE DRAWINGS

Embodiments of the disclosure are illustrated by way of example and not limitation in the figures of the accompanying drawings in which like references indicate similar elements.

DETAILED DESCRIPTION

Figure 1:
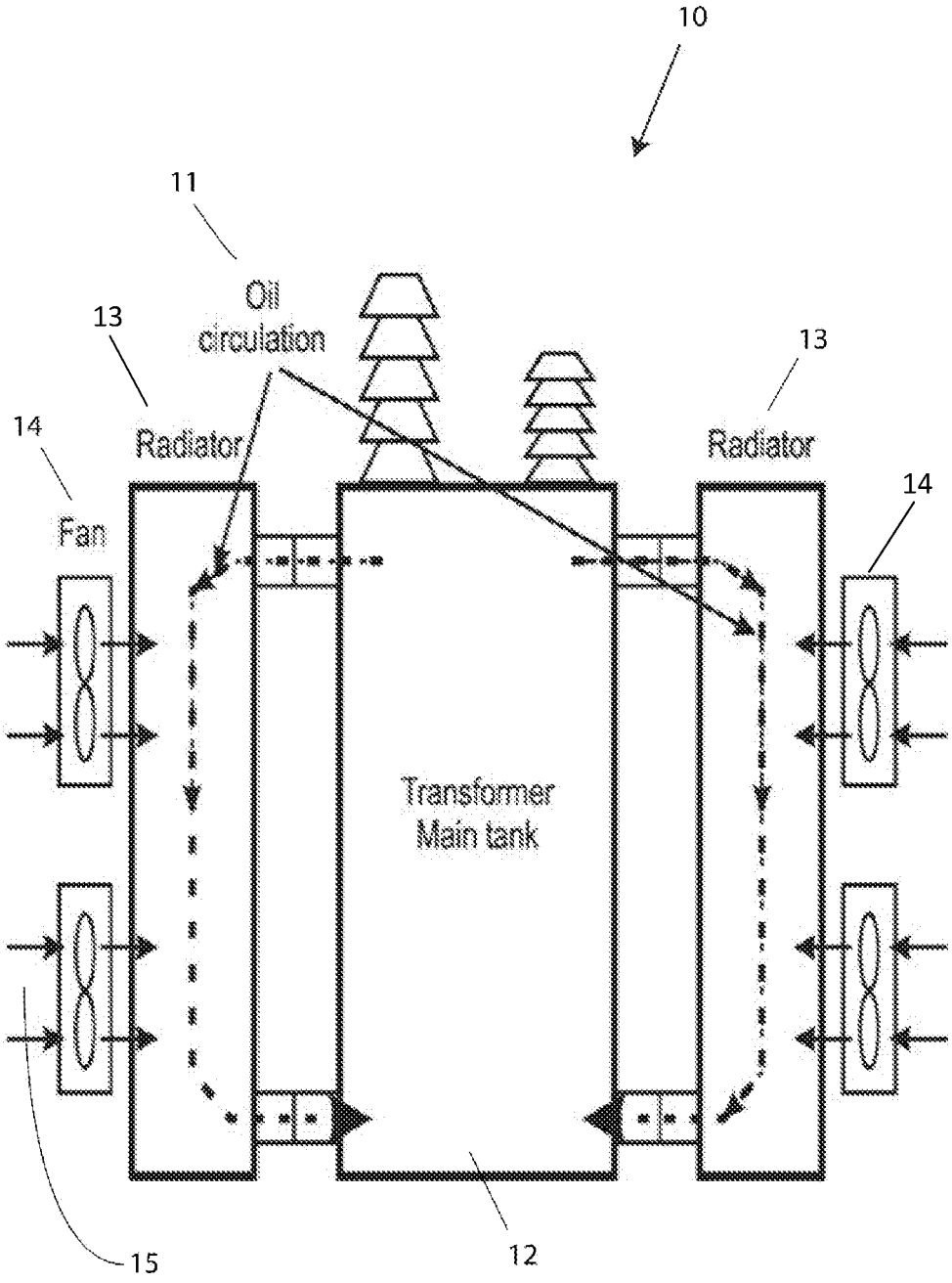
FIG. 1 (Prior Art)
FIG. 1 is a schematic view of a prior art transformer.

Various embodiments and aspects of the disclosures will be described with reference to details discussed below, and the accompanying drawings will illustrate the various embodiments. The following description and drawings are illustrative of the disclosure and are not to be construed as limiting the disclosure. Numerous specific details are described to provide a thorough understanding of various embodiments of the present disclosure. However, in certain instances, well-known or conventional details are not described in order to provide a concise discussion of embodiments of the present disclosures.

Reference in the specification to "one embodiment" or "an embodiment" means that a particular feature, structure, or characteristic described in conjunction with the embodiment can be included in at least one embodiment of the disclosure. The appearances of the phrase "in one embodiment" in various places in the specification do not necessarily all refer to the same embodiment.

A passive cooling topology and a manufacturing method are described for a transformer to achieve improved power density at a light weight. No fans or cooling liquids are required.

Vertical planar faces are used for the central core element, primary and secondary windings, an outer core element, and a heat sink. The primary flow for thermal cooling is radial, through the vertical planar faces. The transformer is floating at the potential of a high voltage transmission line, leading to improved thermal characteristics. Eddy currents are reduced using repeating air gaps in the central core, and a continuously transposed cable comprising multiple strands per turn in the secondary winding. Air pockets in the windings are eliminated using a potting resin and vacuum pressure impregnation (VPI).

According to some embodiments, a transformer is described. The transformer includes a central core having a vertical planar face, a primary winding having a vertical planar face, at least one secondary winding having a vertical planar face, an outer core having a vertical planar face, a heat sink, and a clamping plate to compress the central core, the primary winding, the at least one secondary winding, and the outer core together to minimize air pockets in the primary winding and the at least one secondary winding and to maximize conductive cooling of the transformer. In some embodiments, primary heat flows through the vertical faces of the central core, the primary winding, the at least one secondary winding, and the outer core in a radial direction extending from the central core to the heat sink.

According to another embodiment, a method for constructing a transformer is described. In one aspect, a primary and a secondary winding are provided, where each of the primary and secondary windings has a planar vertical face. A central core and an outer core are provided, where each of the central core and the outer core has a planar vertical face. In one embodiment, the planar vertical face of the central core is matched to the planar vertical face of the secondary winding and the planar vertical face of the outer core is matched to the planar vertical face of the primary winding. A heat sink having a planar vertical face and a clamping plate are provided. Air pockets within the primary and secondary windings are filled with resin using, for example, vacuum pressure impregnation (VPI). Any air gaps at an interface between the clamping plate and the heat sink are filled with electrically conductive filler. The central core, the primary and secondary windings, and the outer core are clamped together, by the clamping plate, to form an integrated block having low thermal impedance in a heat flow path extending from the central core to the heat sink.

FIG. 1 is a schematic view of a prior art transformer. In FIG. 1, transformer 10 is cooled using oil circulation 11 around the windings in a transformer main tank 12. The oil is cooled in radiators 13 that are air cooled using fans 14. Pumps (not shown) are required to circulate the oil. The pumps, the oil, the radiators, and the fans all contribute to the overall size and weight of transformer 10, thereby making this architecture unsuitable for power flow control systems that may be mounted on power transmission lines.

Figure 2:
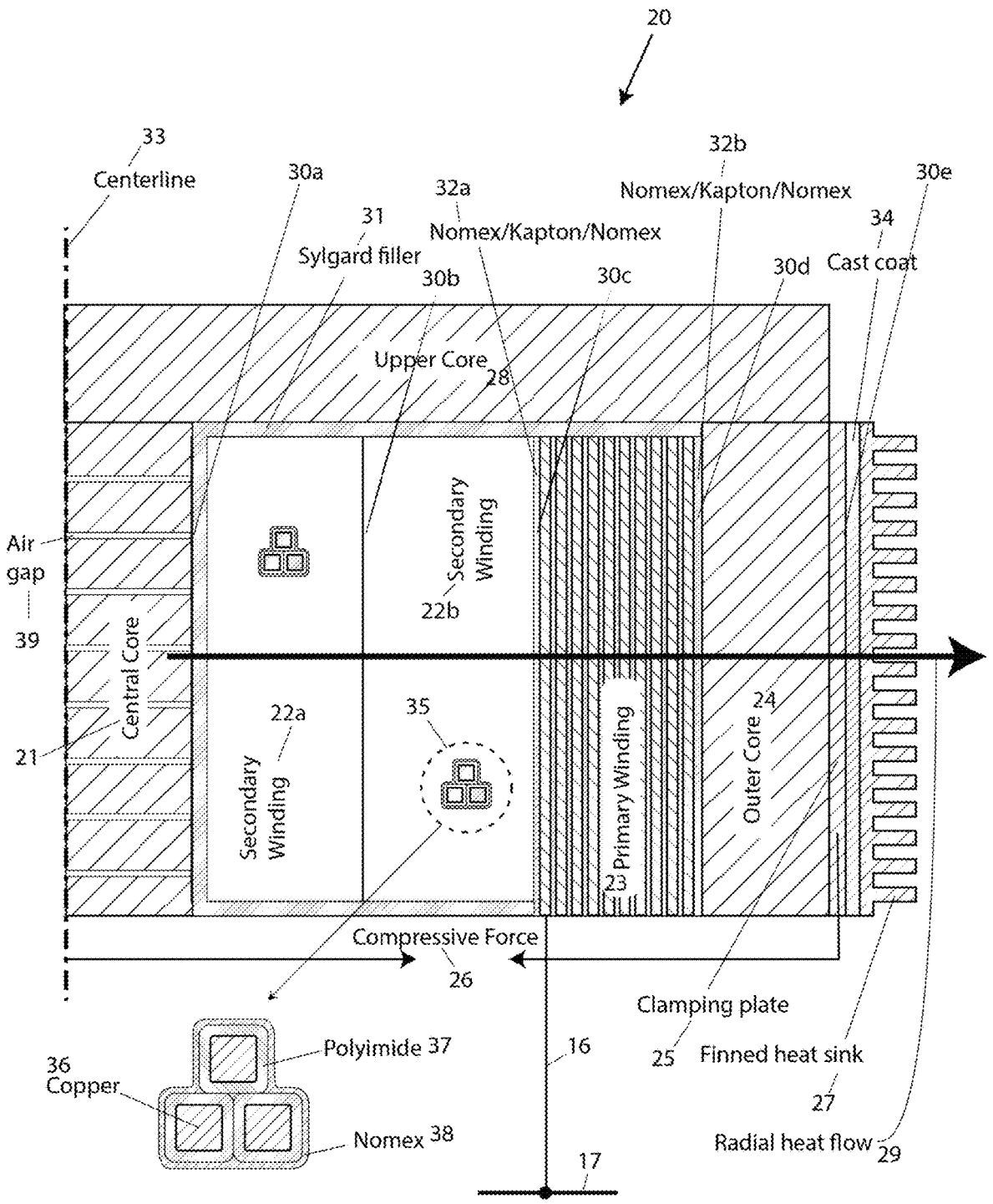
FIG. 2 is a cross-sectional view of a passive cooling transformer according to one embodiment.

FIG. 2 is a cross-sectional view of a passive cooling transformer according to one embodiment. In one embodiment, transformer 20 may be implemented as part of a power flow control device (e.g., an impedance injection module) connected (or attached) to a high-voltage (HV) transmission line. Referring to FIG. 2, with reference to centerline 33, topology of transformer 20 includes a central core 21, secondary windings 22*a* and 22*b*, a primary winding 23, an outer core 24, a clamping plate 25 that provides compressive force 26 (as shown), and a heat sink 27 (e.g., finned heat sink). It should be noted that while FIG. 2 shows secondary windings 22*a* and 22*b* and primary winding 23, any suitable number of primary and secondary windings may be used in the topology of transformer 20. In one embodiment, the primary heat flow is radial heat flow 29 extending from approximately centerline 33 (at central core 21) to heat sink 27, and from heat sink 27 to the surrounding air. In one embodiment, primary winding 23 may include a single foil of flat copper sheeting. Primary winding 23 may also employ multiple foils or sheets. Primary winding 23 may be wrapped with an insulation layer (e.g., Nomex-Kapton-Nomex (NKN)) to provide electrical isolation and effective thermal conductivity.

Still referring to FIG. 2, an upper core 28 magnetically connects or couples central core 21 to the outer core 24. Vertical faces are shown orthogonal to the radial heat flow 29. Therefore, the primary heat flows through the vertical surfaces in a radial direction (as illustrated by radial heat flow 29). For example, illustrated are vertical face 30*a* of the central core 21, vertical face 30*b* of first secondary winding 22*a*, vertical face 30*c* of a second secondary winding 22*b*, vertical face 30*d* of primary winding 23, and vertical face 30*e* of the outer core 24. Primary heat therefore flows through vertical faces 30*a-e* in the radial direction (as shown by radial heat flow 29) and dissipates at heat sink 27). Clamping plate 25 applies compressive force 26 to compress or fasten the overall assembly in the radial direction in order to maximize thermal conduction between central core 21, secondary windings 22*a*, 22*b*, primary winding 23, outer core 24, and heat sink 27. Although these transformer elements or components are fabricated with precise dimensions, manufacturing tolerances may result in minor size variations that must be accommodated with air gaps (or air pockets), although these are minimized by compressive force 26 using clamping plate 25. These air gaps are filled with materials having high thermal conductivity to minimize thermal resistance to radial heat flow 29. Electrically insulating filler 31 (e.g., SYLGARD™ filler) may be used as shown, for example between central core 21 and secondary winding 22*a*. In one embodiment, electrically conductive filler 34 (e.g., Cast Coat filler) may also be used as shown, at the interface between clamping plate 25 and heat sink 27. Clamping plate 25 may be of metal having good thermal conductivity, or equivalently, low thermal resistance.

It is an object of the present disclosure to minimize thermal resistance between the central core 21 and heat sink 27. This is achieved at some interfaces by using polyimide layers, such as Kapton having both a high breakdown voltage and good thermal conductivity. The breakdown voltage of Kapton can be as high as 250 volts per micrometer for example. Since transformer 20 is used for power flow control devices that may be attached to a high voltage (HV) transmission line, and since the HV transmission line is generally carried at a sufficient height above ground to maintain safety for humans on the ground, it is both safe and greatly beneficial to float transformer 20 at the potential of the HV transmission line. In one embodiment, the topology of transformer 20 may include a shorting conductor (e.g., shorting strap 16) disposed between a primary or secondary winding terminal and the HV transmission line 17 to connect the terminal to the HV transmission line. When this is done, the requirement for insulation resistance between the secondary winding 22*b* and primary winding 23 is greatly reduced. For example, a transmission line carrying 290 kV may normally require a thickness of at least 1,200 micrometers if Kapton is used to insulate between the windings. However, in transformer 20, the voltage breakdown requirement is determined by the voltage injection level used, which is typically of the order of 1,000 volts. Accordingly, if Kapton 32*a* is used at the interface between primary winding 23 and secondary winding 22*b*, the required thickness may be reduced from around 1,200 micrometers to around 5 micrometers, thereby reducing the thermal resistance of this element in radial heat flow 29 by a factor of around 240. This lowered thermal resistance will result in transformer 20 having an improved power density, thereby resulting in lighter weight and smaller size.

Despite best efforts to compress the overall assembly indicated by the topology of transformer 20 into a unitary body to minimize air pockets and maximize conductive cooling, typically some air pockets will remain. As high transformer voltages are applied in the windings, arcs can be produced in the air pockets if they are not filled with an insulating material. Accordingly, the air pockets are filled with an insulating resin using vacuum pressure impregnation (VPI). A preferred resin will have both high insulation resistance and high thermal conductivity.

Power density may also be improved by reducing thermal losses in a transformer assembly represented by the topology of transformer 20. For example, eddy current losses create heat that must be removed, as it negatively impacts the achievable power density. In FIG. 2, a repeating horizontal air gap 39 is shown in central core 21. Air gap 39 limits or reduces magnetic saturation of this core element, providing a more linear transformer performance, and also serves to reduce eddy currents. In addition, each turn 35 of secondary windings 22*a*, 22*b* is preferably constructed using multiple insulated conductors wound using a continuously transposed cable (CTC) configuration, including, for example, a number of copper conductors per turn. Each conductor 36 may be wrapped with a polyimide layer 37 (e.g., Kapton), and each turn 35 (i.e., the group of polyimide-wrapped conductors 36) may be wrapped with an insulation layer 38 (e.g., Nomex) to provide electrical isolation and effective thermal conductivity. This combination of layers or materials optimizes the combined electrical and thermal performance/characteristics of secondary windings 22*a*, 22*b*, while also serving to reduce eddy current losses.

Various materials and combinations of materials may be used as insulating wraps, including polyimide (e.g. Kapton), Nomex, Nomex/Kapton/Nomex, and Thermavolt® available from 3M™ Company, thus allowing optimization of both insulation and thermal conduction properties for each location where a wrap is used.

Figure 3:
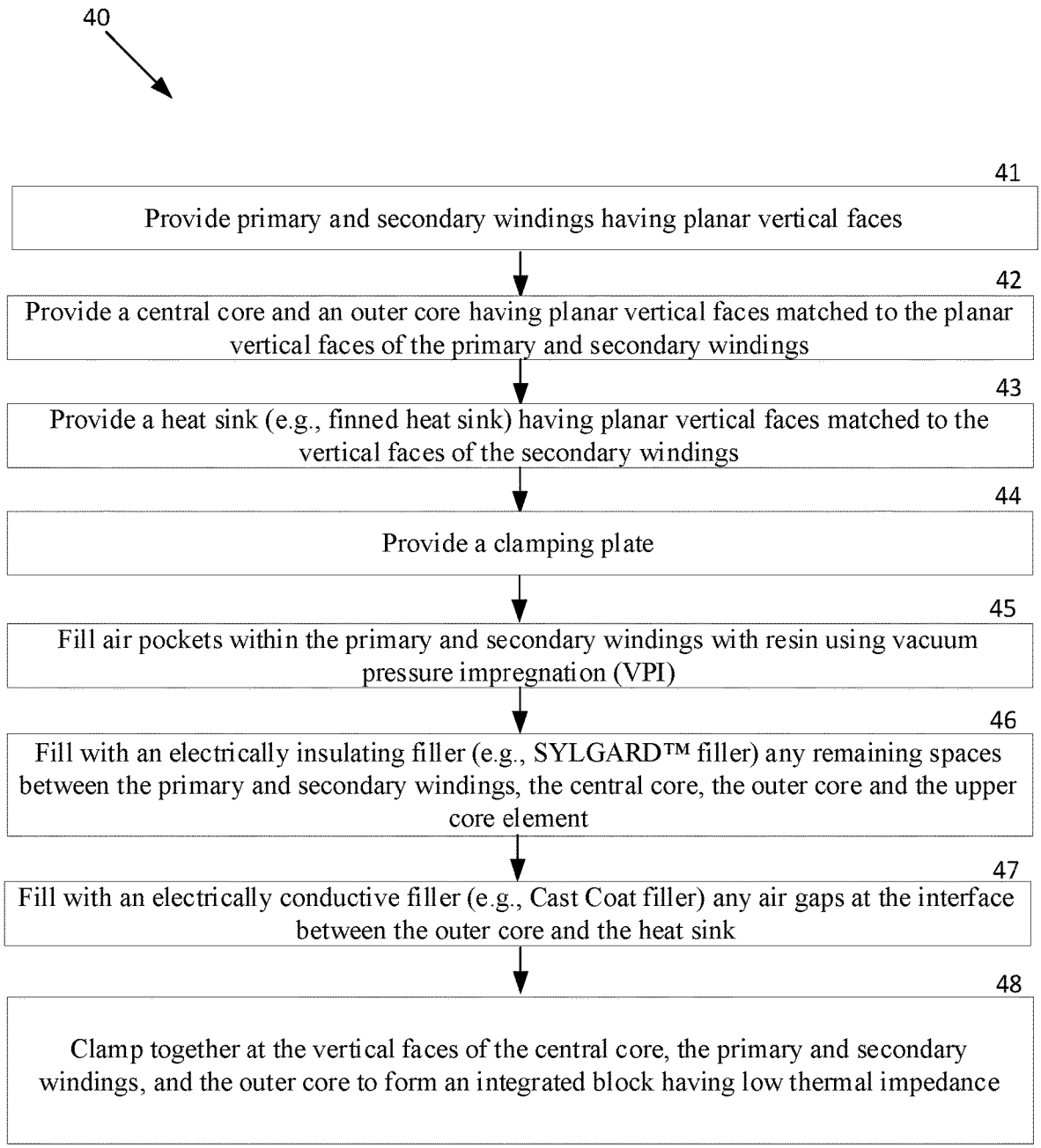
FIG. 3 is a flow chart of a method for constructing a transformer according to one embodiment.

FIG. 3 is a flow chart of a method for constructing a transformer according to one embodiment. In some embodiments, the transformer may include the topology of transformer 20, as previously described with respect to FIG. 2.

Referring to FIG. 3, at block 41, primary and secondary windings having planar vertical faces are provided. At block 42, a central core and an outer core having planar vertical faces matched to the planar vertical faces of the primary and secondary windings are provided. At block 43, a heat sink (e.g., finned heat sink) having planar vertical faces matched to the vertical faces of the secondary windings is provided. At block 44, a clamping plate (e.g., metal clamping plate) is provided. At block 45, air pockets within the primary and secondary windings are filled with resin using vacuum pressure impregnation (VPI). At block 46, any remaining spaces between the primary and secondary windings, the central core, the outer core and the upper core element are filled with an electrically insulating filler or potting material (e.g., SYLGARD™ filler). At block 47, any air gaps at the interface between the outer core and the heat sink are filled with an electrically conductive filler (e.g., Cast Coat filler). At block 48, at the vertical faces, the central core, the primary and secondary windings and the outer core are clamped together to form an integrated block having low thermal impedance.

While the disclosure has been described in terms of several embodiments, those of ordinary skill in the art will recognize that the invention is not limited to the embodiments described, but can be practiced with modification and alteration known to practitioners of the art. These modifications and alternate practices, though not explicitly described, are covered under the current application. The practice of the invention is further covered within the spirit and scope of the appended claims. The description is thus to be regarded as illustrative instead of limiting. There are numerous other variations to different aspects of the invention described above, which in the interest of conciseness have not been provided in detail. Accordingly, other embodiments are within the scope of the claims.

What is claimed is:

1. A transformer comprising:

a central core having a vertical planar face;

a primary winding having a vertical planar face;

at least one secondary winding having a vertical planar face;

an outer core having a vertical planar face, the outer core being different from the central core;

a heat sink; and a clamping plate to compress the central core, the primary winding, the at least one secondary winding, and the outer core together forming an integrated block, to minimize air pockets in the primary winding and the at least one secondary winding and to maximize conductive cooling of the transformer;

wherein heat flows through the vertical planar faces of the central core, the primary winding, the at least one secondary winding, and the outer core in a radial direction from the central core to the heat sink;

wherein the central core, the primary winding, the at least one secondary winding, the outer core, and the heat sink are arranged with symmetry about a centerline of the integrated block.

2. The transformer of claim 1, further comprising a shorting conductor disposed between (i) either a terminal of the primary winding or a terminal of the at least one secondary winding and (ii) a high voltage (HV) transmission line, to connect the terminal of the primary winding or the terminal of the at least one secondary winding to the HV transmission line.

3. The transformer of claim 1, wherein air pockets in the primary winding and the at least one secondary winding are filled with a resin using vacuum pressure impregnation (VPI).

4. The transformer of claim 1, wherein the central core comprises repeating air gaps to reduce magnetic saturation and improve linearity of the performance of the transformer.

5. The transformer of claim 1, wherein the at least one secondary winding comprises a continuously transposed cable (CTC) having multiple conductors in each turn of the winding.

6. The transformer of claim 1, further comprising an upper core that magnetically couples the central core to the outer core.

7. The transformer of claim 6, wherein an interface between (i) any of the primary or the at least one secondary windings, and (ii) any of the central core, the outer core, or the upper core is filled with an electrically insulating filler or potting material to eliminate air gaps and improve heat transfer at the interface.

8. The transformer of claim 1, wherein an interface between the outer core and the heat sink is filled with an electrically conductive filler to eliminate air gaps and improve heat transfer at the interface.

9. The transformer of claim 1, wherein the primary winding comprises flat copper sheeting.

10. The transformer of claim 5, wherein each conductor of the secondary winding is wrapped with a polyimide layer, and a plurality of conductors comprising a turn of the secondary winding is collectively wrapped with an insulation layer in a continuously transposed cable configuration.

11. The transformer of claim 10, wherein the polyimide layer is Kapton and the insulation layer is Nomex.

12. A transformer comprising:

a central core having a vertical planar face;

a primary winding having a vertical planar face;

a secondary winding having a vertical planar face;

an outer core having a vertical planar face, the outer core being different from the central core;

a heat sink; and a clamping plate to clamp the central core, the primary winding, the secondary winding, and the outer core together forming an integrated block;

wherein heat flows through the vertical planar faces of the central core, the primary winding, the secondary winding, and the outer core in a radial direction from the central core to the heat sink.

13. The transformer of claim 12, further comprising a shorting conductor that connects either a terminal of the primary winding or a terminal of the secondary winding to a high voltage (HV) transmission line.

14. The transformer of claim 12, wherein the secondary winding comprises a plurality of conductors wound in a continuously transposed cable (CTC) configuration in each turn of the winding for reducing eddy currents in the secondary winding.

* * * * *